US006921076B1

(12) United States Patent
Norton

(10) Patent No.: US 6,921,076 B1
(45) Date of Patent: Jul. 26, 2005

(54) CRANE GAME GRABBER APPARATUS AND METHOD

(76) Inventor: David A. Norton, 4910 W. Linebaugh, Tampa, FL (US) 33624

( * ) Notice: Subject to any disclaimer, the term of this patent is extended or adjusted under 35 U.S.C. 154(b) by 0 days.

(21) Appl. No.: 10/369,972

(22) Filed: Feb. 20, 2003

Related U.S. Application Data

(60) Provisional application No. 60/361,005, filed on Mar. 1, 2002.

(51) Int. Cl.[7] ..... A63B 7/36
(52) U.S. Cl. ..... 273/447
(58) Field of Search ..... 279/440, 447, 279/448

(56) References Cited

U.S. PATENT DOCUMENTS

| | | | | |
|---|---|---|---|---|
| 0,528,827 A | | 11/1894 | Thomas | |
| 3,733,747 A | * | 5/1973 | Fox et al. | 49/30 |
| 4,202,545 A | * | 5/1980 | Watanabe | 273/108.2 |
| 4,718,667 A | | 1/1988 | Shoemaker | |
| 5,415,417 A | | 5/1995 | Reis, Jr. | |
| 5,453,053 A | * | 9/1995 | Danta et al. | 472/29 |
| 6,062,567 A | | 5/2000 | Uetono et al. | |
| 6,283,475 B1 | | 9/2001 | Stubben | |
| 6,311,981 B1 | | 11/2001 | Uetono et al. | |
| 6,598,881 B1 | * | 7/2003 | Shoemaker, Jr. | 273/447 |
| 2003/0151202 A1 | * | 8/2003 | Fisher et al. | 273/447 |

FOREIGN PATENT DOCUMENTS

JP 01-149522 * 6/2001

* cited by examiner

*Primary Examiner*—Raleigh W. Chiu
(74) *Attorney, Agent, or Firm*—David Kiewit

(57) ABSTRACT

A crane game, of the sort popular in amusement arcades, has prizes supported on a horizontal surface arranged to move upwards as prizes are delivered to players. Prize separating posts extend through the movable horizontal surface to keep deformable prizes near the bottom of the prize bin from being jammed together. This allows the game to hold a greater prize inventory. In addition, an arrangement is provided for measuring and displaying the grabbing force being exerted by the prize grabbing mechanism in order to assure a player of the game that it is performing in a consistent manner.

7 Claims, 5 Drawing Sheets

CRANE GAME GRABBER APPARATUS AND METHOD

CROSS REFERENCE TO RELATED APPLICATIONS

This application claims the priority of U.S. Provisional Application 60/361,005, filed on Mar. 1, 2002.

BACKGROUND

Crane games have been a popular fixture in amusement arcades for many years. These games generally provide a player, who pays some predetermined amount for each game, with an opportunity to use a traversing mechanism to move a grasping mechanism laterally above a bin filled with prizes so as to attempt to select one of the prizes below the grasping mechanism. The grasping mechanism is then lowered into the bin where it may grasp one of the prizes which can then be lifted upwards, moved laterally until it is over a delivery chute, and dropped into the chute from wihch it can be removed by the player. The prizes are often soft stuffed toys and are generally deformable so as to make them easier to grasp with a clawed mechanism.

Prior art crane games commonly have only one or two layers of prizes in their bins. This requires an operator to frequently open the game's housing and load additional merchandise to replace items delivered to players. Attempts to reduce the frequency of service calls for re-loading by simply using a deeper bin and piling the prizes higher have not worked well because both the weight of prizes near the top of the pile and the tamping effect of the dropping claw compact the deformable prizes stored below them. After the uppermost prizes are removed during play, the remaining prizes are so thoroughly jammed together that the grasping mechanism is unable to lift one of them out of the compacted and interlocked pile.

Whether or not the claw mechanism is attempting to pick up a lone prize resting on a floor of a bin or to extricate one of many prizes from a pile of prizes, players of crane games are often concerned about the degree to which the claw mechanism performs reliably and consistently. Stubben (U.S. Pat. No. 6,283,475) describes a solenoid-actuated crane game claw in which a input from a game operator, rather than from a player, is used to select a solenoid drive current that determines the closing force of the claw. Stubben does not teach the use of a motor and gear drive for actuating the claw. Moreover, the only controlled parameter in Stubben's apparatus is a solenoid drive current. In addition, the operator input in Stubben's apparatus is of a conventional type that allows the value of the controlled parameter to be hidden from a user of the game.

A known crane game grasping mechanism uses a worm gear turned by the motor to drive a worm gear follower attached to the claws so that the claws move between an open and a closed position. Travel-limiting stops at both ends of the worm are used by the game operator to set the open limit and closed limit positions. When the worm gear nut attached to the claws runs into either of the travel-limiting stops, its progress along the worm is stopped and the motor stalls out. This arrangement limits the sizes of both the largest and smallest prizes that can be picked up, and coacts with the elastic properties of the prizes to provide a range of gripping forces. The gripping force, however, is not directly controlled.

SUMMARY OF THE INVENTION

One preferred embodiment of the invention comprises an improvement to a crane game in which a player causes a grasping mechanism to be lowered onto one of a plurality of deformable prizes in a bin, lifts that prize and conveys it laterally to a delivery chute. The improvement may comprise a vertically movable, horizontally extensive support, which may be a sheet having a plurality of throughholes, or may be a grid of rods or wires. The movable support is used for supporting at least some of the prizes and is coupled to a drive mechanism used to raise and lower the support. The preferred drive mechanism is controlled by a controller having an input indicative of a player's action. In addition, preferred embodiments comprise a plurality of vertical prize separating posts extending upwardly through the prize support, at least when the prize support is at its lowest position.

These embodiments are compatible with a method of operating a crane game wherein at least some of a plurality of players use a grasping mechanism to pick up a respective one of a plurality of prizes disposed within a bin in order to convey the picked up one of the prizes to a delivery chute. A preferred method begins with a game operator loading the plurality of prizes into the bin prior to any of the players using the grasping mechanism and arranging the prizes so that at least a first fraction of the prizes lie on a raisable support and are separated from each other by posts protruding vertically upward by a selected vertical extent through the raisable support, and so that a second fraction of the prizes, lying above the first fraction of the prizes, extend above the selected vertical extent of the posts. Subsequent steps in using the game comprise raising the raisable support responsive to at least one player's action so as to bring an uppermost one of the prizes closer to the grasping mechanism. In one version of the method, a prize delivery counting mechanism supplies an input to a controller that tracks the number of prizes being removed by players and that controls the raisable support to move incrementally upward each time a prize, or a selected number of prizes is delivered down the delivery chute. Another embodiment tracks the amount of finds deposited into the game by players and raises the floor in response the number of plays. Both of these approaches to controlling the game allow for a more or less constant degree of difficulty in winning a prize inasmuch as the vertical distance from a grasping mechanism to an uppermost one of the prizes in the bin can be held roughly constant. Alternately, one can allow the movable floor to be raised responsive to a player depositing additional funds into the game or otherwise making a payment to play.

A preferred embodiment of the invention provides a grasping mechanism for a crane game in which the grasping mechanism comprises a plurality of claws driven by an electric motor acting through a slip clutch. A parameter, such as shaft torque or motor drive current, representative of a force being applied to a claw, is used as an input to a controller that controls an electro-mechanical actuator, other than the drive actuator, to regulate the torque at which the clutch begins to slip. In a particular preferred embodiment, the electric motor is coupled through a speed reduction gear arrangement to one side of the slip clutch and a worm gear is directly coupled to the other. In this embodiment each claw is hingedly mounted and comprises gear teeth that can mate with the worm gear so that rotation of the worm opens and closes the multi-clawed mechanism.

In addition to measuring a parameter representative of grasping force and using it in closed-loop control arrangement to control the grasping force, a preferred embodiment of the invention provides a visual display of the grasping force to a player of the crane game. This display, which is preferably a numeric digital display, is used to assure the player that the claw mechanism is performing consistently and is providing a relatively constant grasping force for a wide variety of prize sizes and shapes.

It is thus a specific objective of some embodiments of the invention to provide a method of operating a crane game in which a parameter representative of a grasping force applied by a claw mechanism is measured and a number representative of the measured value of the parameter is visually displayed to a player while the game is in progress.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the hereinbefore recited features and advantages of the invention, and that less than all of the recited features and advantages may be provided by some embodiments.

DETAILED DESCRIPTION

Figure 1:
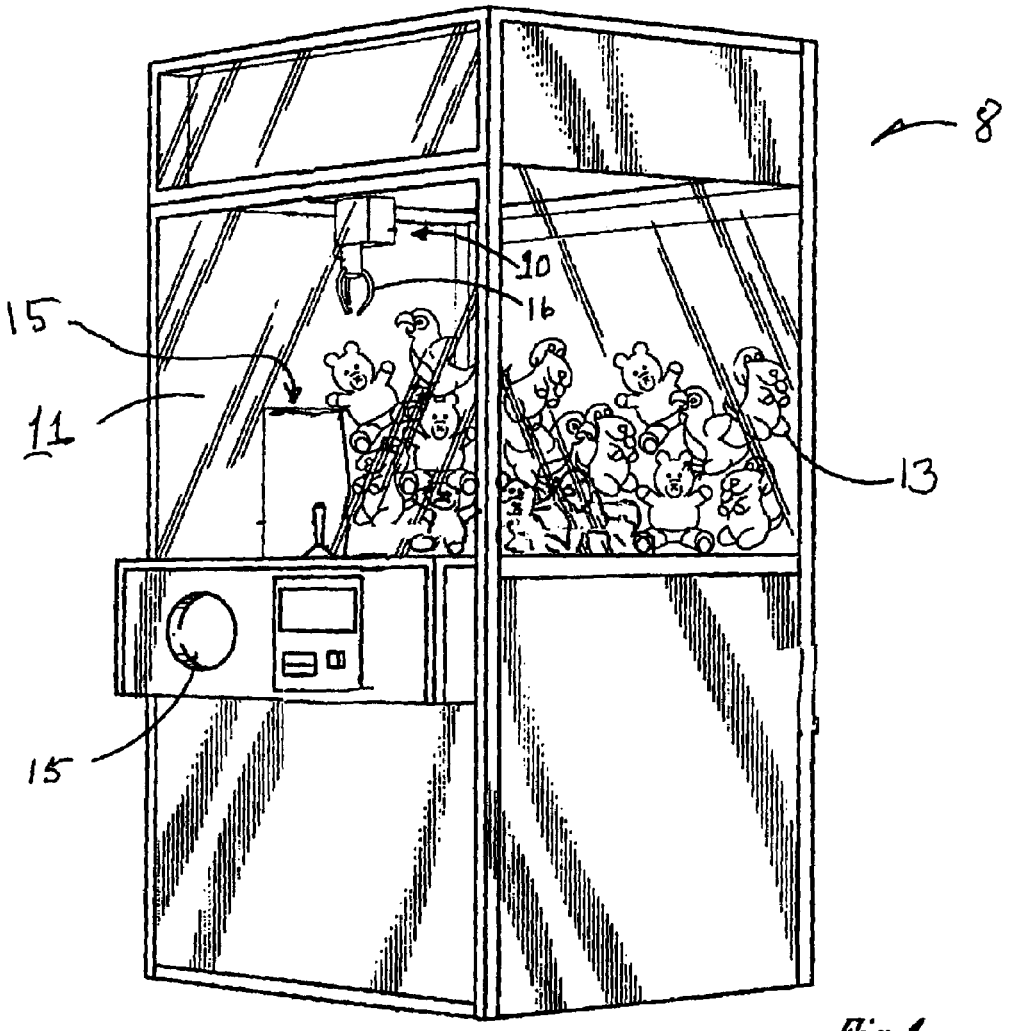
FIG. 1 is an elevational view of a crane game comprising prize raising, prize separation and prize grasping mechanisms of a preferred embodiment of the invention.
Figure 2:
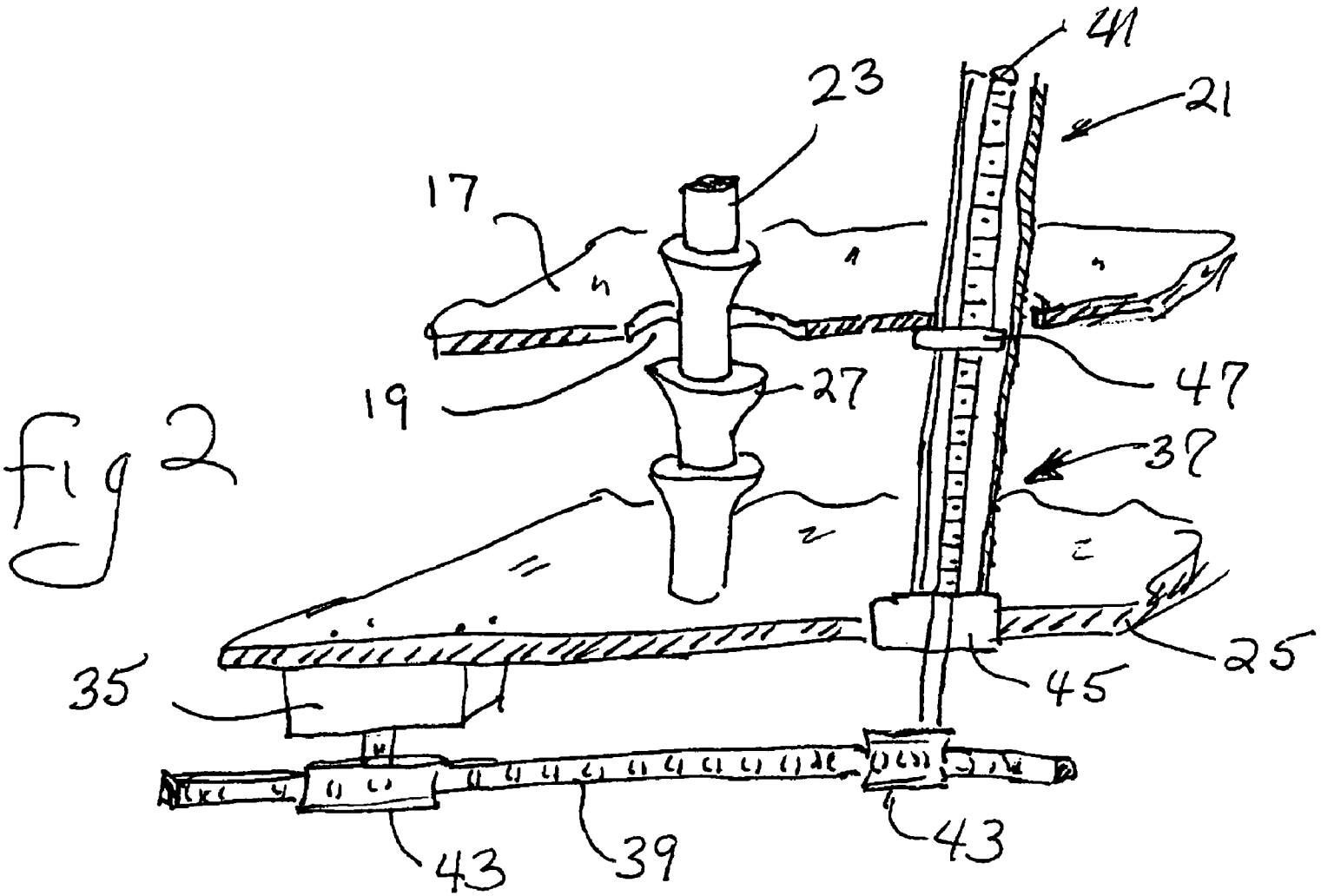
FIG. 2 is a partly cut-away detailed view of a preferred embodiment, the view depicting a prize raising and separation mechanism.
Figure 3:
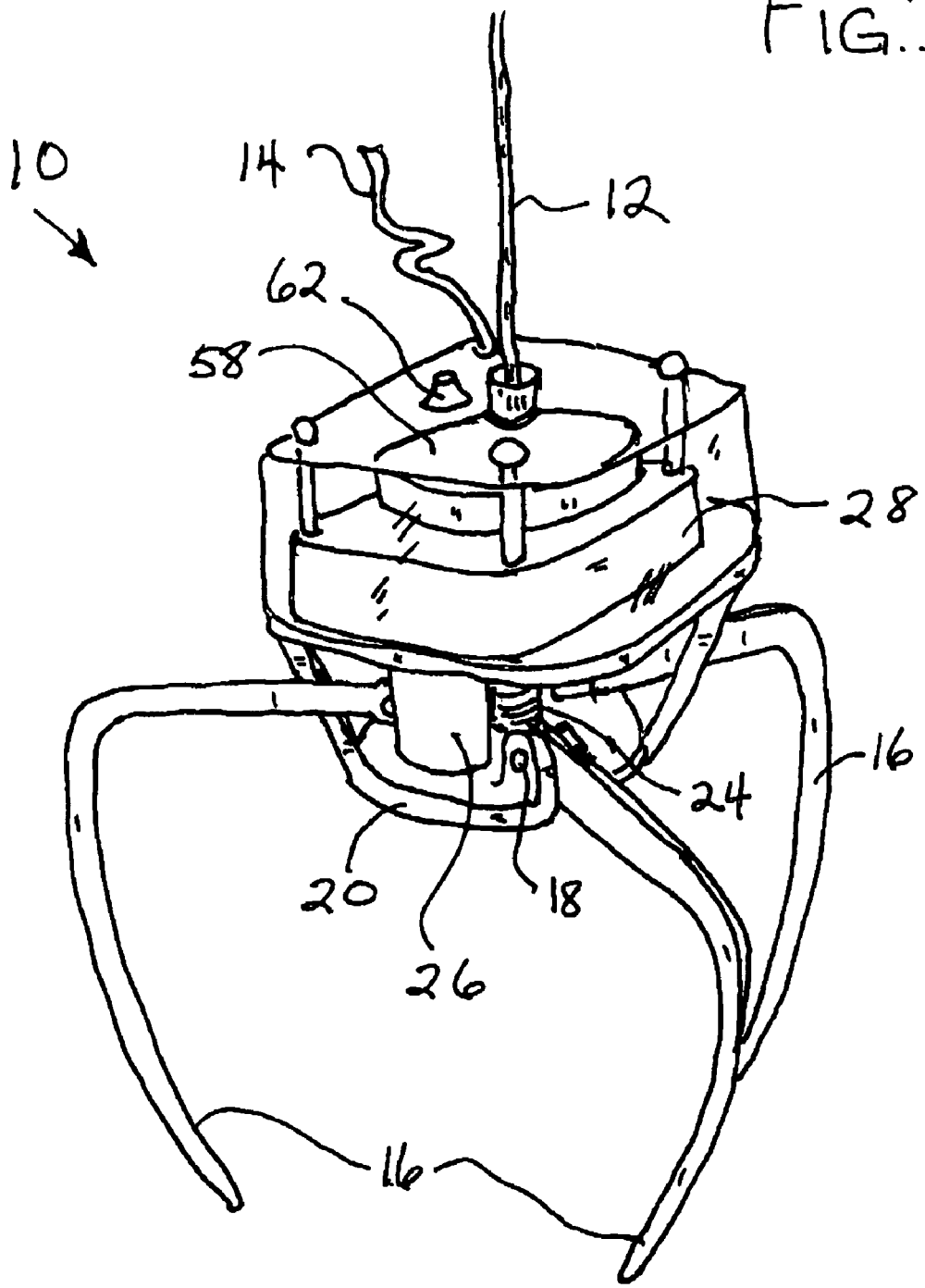
FIG. 3 is an elevational view of a preferred grasping mechanism of the invention.

A preferred crane game 8 of the invention comprises a grasping mechanism 10, which preferably provides a controllable grasping force, as will be subsequently disclosed. As is conventional in crane games, the grasping mechanism 10 can be moved generally horizontally under player control above a bin 11 containing a plurality of prizes 13, which are usually soft, readily deformable items such as stuffed toys. The grasping mechanism 10 is lowered onto the prizes 13 so that it may grasp one of them, lift it upwards, and convey it to a delivery chute 15 or other suitable delivery means for removal by a player.

As discussed above, a problem with prior art crane games is that the weight of prizes near the top of the bin 11 can deform and compact prizes lower down in the bin. When the upper prizes are removed, the lower prizes are commonly so compacted or interlocked as to be difficult or impossible for the grasping mechanism to successfully grasp and raise. Prior art crane games are thus effectively limited to having a bin 11 filled to no more than twice an effective diameter of an average prize. The floor area occupied by a game is also limited, so the problem of prize deformation translates immediately into a limit on the inventory of prizes that may be stocked in a game. This limit, in prior art games, is so low as to require objectionably frequent service calls for restocking the game.

A preferred embodiment of the invention comprises a horizontally extensive, vertically movable prize support 17, which may be configured as a grid formed from appropriate rods, dowels or the like, or which may be a more or less continuous perforate sheet. Regardless of the choice of structure, the preferred support 17 comprises a plurality of throughholes 19. In a preferred embodiment a respective elevator post 21, used for raising and lowering the support 17, extends through at least three, or preferably, four of the throughholes 19. A plurality of stationary prize-separating post 23 extends upwardly from a fixed sub-floor 25 so that each of the posts 23 extends through a respective throughhole 19. Those skilled in the mechanical arts will recognize that one could equally well choose a different support driving mechanism for raising and lowering the support. Such an arrangement, e.g., using lifting cables secured to corners of the support, might not require an active, or elevator, post to protrude through any of the throughholes, in which case a respective stationary prize separating post could extend through each of the throughholes. Moreover, it will be recognized that if the average prize size increases, some of the posts could be removed, leaving throughholes through which nothing extended.

A preferred stationary prize separating post 23 has a height selected so that when the prize supporting surface is raised to its uppermost position, the post does not extend above the supporting surface by an amount comparable to the size of a prize. This choice can ensure that a post is not exposed above the tops of the prizes and does not interfere with operation of the grasping mechanism. On the other hand, when the support 17 is at its lowermost position, the vertical posts extend upwardly through the throughholes far enough to effectively separate prizes near the bottom of the pile of prizes so that those prizes can not be compacted together. In addition, a preferred stationary post 23 comprises a plurality of serrations 27 shaped so as to allow prizes abutting the serrations to easily move upward when lifted by the rising support 17, and to inhibit the prizes from moving downwardly.

Although there are many possible choices for a mechanism usable to raise and lower the prize support 17, a preferred embodiment of the invention employs an electric motor 35 drivingly connected to each of a plurality of worm-drive mechanisms 37 by a single flexible drive element 39, which may be a chain or a transversely ribbed belt of the type commonly used for valve timing in internal combustion engines. This arrangement ensures that all of the worm drive mechanisms 37 remain synchronized and also avoids jamming, as would occur if one of the worms turned faster than another, or if failure of a portion of the drive mechanism allowed other portions of it to operate.

A preferred worm drive mechanism 37 comprises a worm shaft 41 having a drive pulley 43 attached adjacent its lower end. This worm shaft 41 is supported in a bearing 45 fastened to the stationary sub-floor 25, and has a worm follower 47 arranged for upward and downward travel along the shaft 41 when it is rotated. The worm follower 47 is also drivingly connected to the prize support 17, which may merely rest upon it, or be otherwise coupled to it so that the support 17 can be selectively raised or lowered by turning the worm shaft 41.

In a preferred crane game 8, a prize counter 49 associated with the delivery chute 15 provides an input to a controller 50 having an output for controlling operation of the support drive motor 35. The counter 49 may be of any of several types known in the art and may include a photoelectric beam that extends across the chute 15 so as to be broken by each prize that falls down the chute. Alternately, it may comprise a micro-switch having a paddle or finger extending into the chute so as to be tripped each time a prize drops down the chute.

The controller 50 preferably operates under control of a stored program and uses the delivery data along with stored parameters related to the size of the bin 11 and of the prizes so as to incrementally raise the support 17 responsive to delivery of the prizes at a rate ensuring that only one or two layers of prizes extend above the tops of the stationary prize separating posts 23. It will be recognized that other inputs to the control can also be used to achieve substantially the same results. For example, because the average success rate for players is generally known to the game operator, one could raise the floor responsive to the amount of payment made by players.

A crane game grabber 10 of the invention, like many similar crane game grabbers, may be suspended by means of a support cable 12 from a conventional mechanism (not shown) used for moving the grabber 10 across a top of a bin 11 portion of a crane game 8. As is usual in the art, electric power for operation of the grabber is supplied by a separate cable 14.

A preferred grabber 10 of the invention comprises a plurality (usually three) of claws 16, each of which is hingedly attached adjacent a proximal end (e.g., by means of a pivot pin 18) to a base plate 20 portion of the grabber. Each of the claws comprises a plurality of gear teeth 22 at its proximal end for engaging a worm gear 24 driven by an electric motor 26. In initial embodiments of the invention the motor 26 acted through a speed reduction gear box 28. In a presently preferred embodiment the worm 24 is loosely fitted about an extended motor shaft 30 of a motor, such as a stepper motor, that does not require speed reduction. In either arrangement a friction clutch 32 is used to connect the motor 26 to the worm 24.

Figure 4:
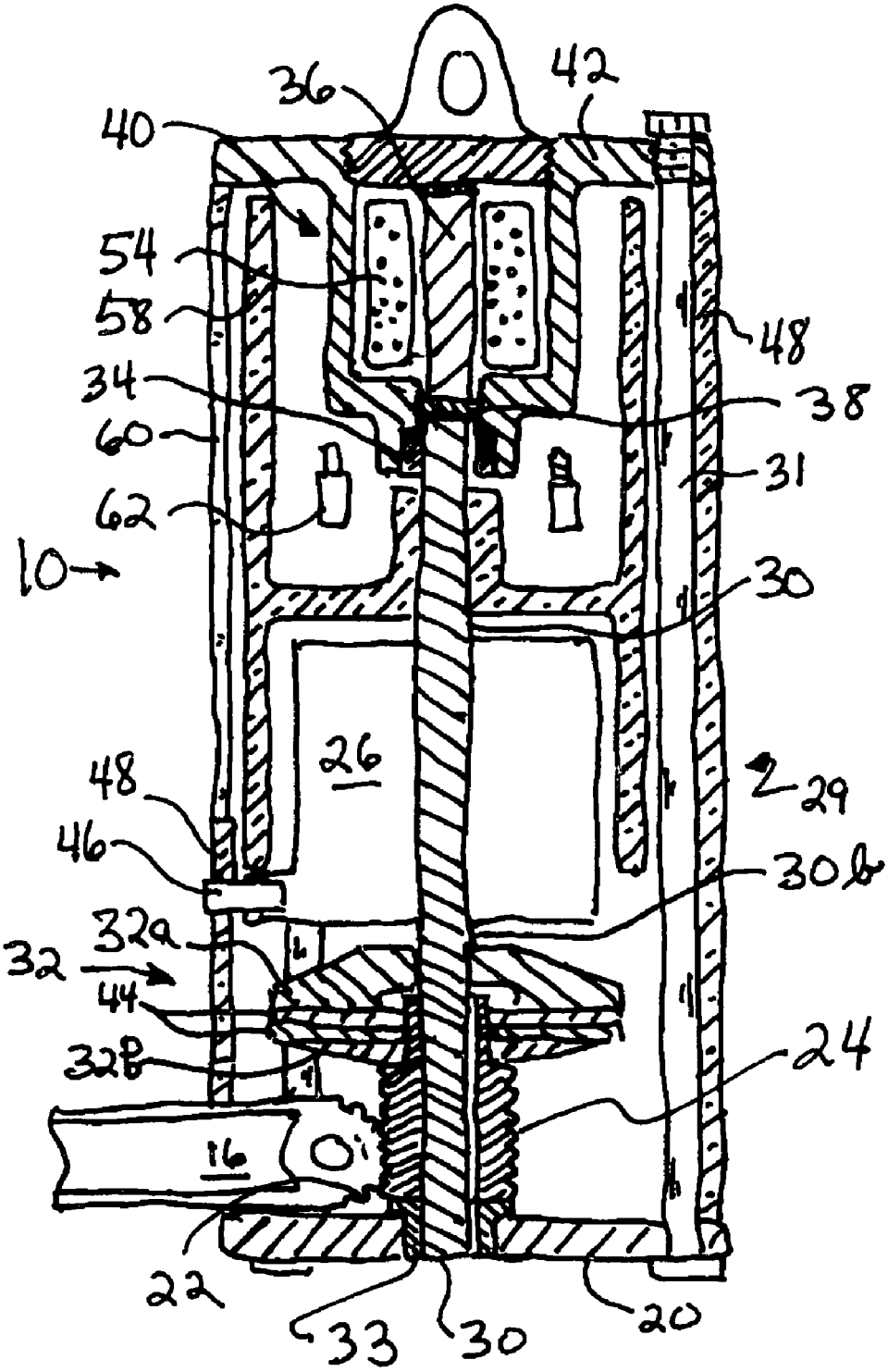
FIG. 4 is a vertical cross sectional view of a preferred embodiment of the invention.
Figure 5:
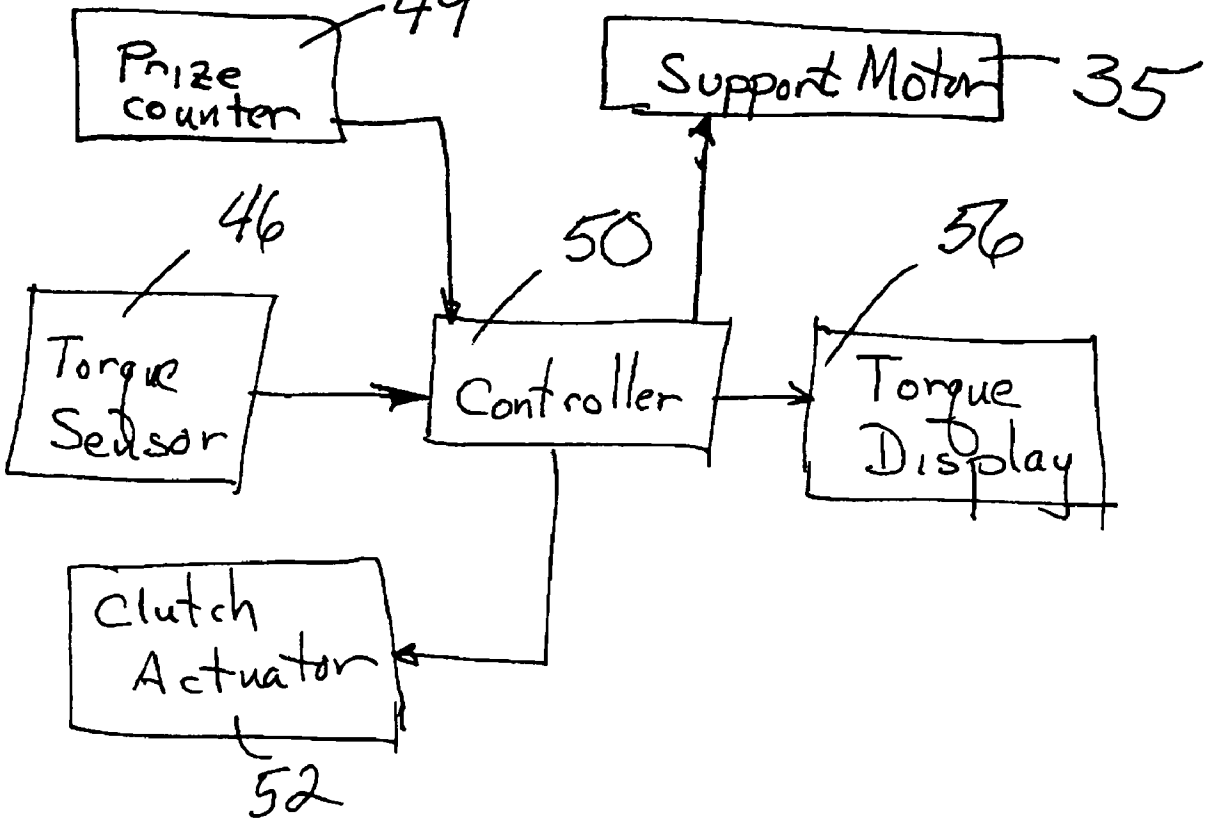
FIG. 5 is a schematic block diagram of a control system portion of the invention.

The preferred grabber 10 depicted in FIG. 4, for example, also comprises a housing 29 comprising a bottom plate 20 to which the claws 16 are pivotally connected; a top plate 42, a cylindrical sidewall portion 48, and a plurality (usually three) of bolts 31 or other connecting members. In addition, the bottom of the shaft 30 is journaled within a bottom bearing 33 arranged to withstand an axial thrust.

In the preferred embodiment depicted in FIG. 4, both the upper 30*a* and lower 30*b* ends of the motor shaft 30 have a D-shaped cross-section. The lower D-shaped section 30*b* is tightly interfitted with the motor side 32*a* of the clutch 32 so that it rotates with the motor shaft. The upper end of the motor shaft 30 is journaled within a top bearing 34 and engages a solenoid plunger 36. The shaft may abut the plunger or, as depicted in FIG. 4, may be connected to the plunger by means of a spacer 38. The body of the solenoid 40 is fixedly attached to a top plate 44 portion of the grabber. This arrangement allows the solenoid 40 to be used to selectively apply an axial clutch actuating force to the motor shaft 30 so as to push the two friction plates 44 of the clutch together so that the worm 24, which is fixedly connected to the driven side 32*b* of the clutch, turns and causes the claws 16 to either open or close, depending on the selected sense of rotation of the motor 26. Conversely, if the solenoid 40 does not actuate the clutch 32 and the friction plates 44 are held apart (e.g., by a spring, not shown), the motor can turn without turning the worm 24 or moving the claws 16.

As is known in the art of using slip clutches, if the clutch 32 is engaged it can allow the motor to turn the worm for all torques less than some maximum value. When the maximum value is exceeded, the friction plates 44 slip and further increases in shaft torque, and thus in grabbing force, are prohibited. The limiting value of torque at which slip begins increases as the clutch actuating force increases. Hence, controlling the excitation of the solenoid 40 allows one to control the maximum grabbing force supplied by the grabber 10.

A preferred grabber 10 comprises a torque sensor 46 for measuring the torque supplied by the motor 26. As depicted in FIG. 4, the torque sensor may be a strain gage transducer connecting the housing of the motor 26 to a cylindrical housing portion 48 of the grabber 10 so as to measure the reaction torque. Those skilled in the measurement arts will recognize that many other methods of measuring or inferring torque (e.g., from known current-voltage characteristics of the DC motor) could equally well be used. Regardless of how the torque value is obtained, it is preferably input to a controller 50, which may comprise a microprocessor operating under control of a program stored in a read-only memory, or which may be any of a wide variety of controllers known in the art. The controller 50 is used to provide a force-regulating output to the clutch actuator 52 so as to control the clutch actuating force and to thereby control the limiting value of applied torque. In the preferred embodiment the clutch actuator 52 is the solenoid 40, which supplies an output force responsive to an electrical current through its windings 54. Thus, the preferred grabber 10 comprises a closed-loop control system for regulating the maximum grabbing force of its claws.

The controller 50, in preferred applications of the invention, provides an output to a torque display 56 used to provide a visual display indicative of the applied torque. The torque display 56 is preferably a digital numeric display that may be disposed on a housing portion 48 of the grabber 10, although many other types of displays such as a moving bar graph, can be used. The display may be located at any other convenient location, such as on a player's console portion of a crane game housing or on an interior wall of the crane game housing. In preferred applications of the invention, the visual display 56 is used to display, to a player of the game, a numerical value representative of the grabbing force being applied. Thus, the player can be assured of the consistent operation of the grabber.

Some preferred embodiments of the grabber 10 also provide a moving visual graphic or textual display that is not related to the force being applied by the grabber closing but that can be used by a game operator to call attention to the game or to heighten a user's enjoyment of the game by having a graphic indicium move at least some of the time when the motor 26 is being operated—e.g., during actuation of the grabber. This display feature is preferably provided by disposing the graphic on a rotatable cylindrical element or drum 58 that is fit onto a D-shaped portion 30*a* of the motor shaft and that is visible through windows 60 cut into the sidewall 48 of the housing. In preferred embodiments the drum 58 is made of a transparent or translucent material and one or more light sources 62 disposed within the drum 48 are used to illuminate whatever graphic or textual content is to be shown to the user. It will be understood to those skilled in the arcade game arts that the light sources can be used in a variety of ways, such as being illuminated whenever the game is being played or flashed occasionally when the game is not being played in order to attract players.

In the foregoing description, a system is disclosed in which a single controller 50 receives inputs from a prize counter 49, and a torque sensor 46 and supplies control outputs to a clutch actuator, a support motor and a torque display. Those skilled in the control arts will recognize that although a control system of this sort may be implemented with a single microprocessor controller, there are many other approaches to providing an equivalent functionality. These include, but are not limited to the use of hardwired logic control, and of multiple microprocessors. Moreover, it will be recognized that adddtional inputs and outputs may be important to a control system of the sort hereinbefore described. Additional inputs, for example, could be provided from limit switches used to set the maximum upward and downward travel of the prize support, or from known coin and bill acceptors. Many additional outputs could be supplied, for example, to control game illumination or to sound an alarm if tampering or theft was detected.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. A crane game apparatus comprising:

a horizontally extensive support for at least one prize available to a player of the crane game, the support vertically movable between a lowest position and a highest position;

a support driving mechanism for raising and lowering the support, the support driving mechanism comprising at least three elevator posts extending upwardly through respective throughholes in the horizontally extensive support when the support is at the lowest position, each of the elevator posts having a respective worm shaft extending therealong, each of the worm shafts having a respective worm follower coupled thereto for upward and downward travel along the worm shaft, each of the worm followers respectively drivingly coupled to the support; and a controller for controlling the support driving mechanism to raise the support responsive to an action of the player.

2. A crane game apparatus comprising:

a horizontally extensive support for at least one prize available to a player of the crane game, the support vertically movable between a lowest position and a highest position;

a support driving mechanism for raising and lowering the support;

a plurality of stationary vertical prize separating posts, distinct from the support driving mechanism, extending upwardly through respective throughholes in the horizontally extensive support when the support is at the lowest position; and a controller for controlling the support driving mechanism to raise the support responsive to an action of the player.

3. The crane game apparatus of claim 2 wherein each of the stationary posts comprises a respective plurality of serrations shaped to allow abutting prizes to move upward when lifted by the movable support.

4. In a crane game apparatus comprising a bin for holding a plurality of prizes and a grasping mechanism for exerting a grasping force on a captured prize deliverable to a player of the game, an improvement characterized in that:

the bin comprises a horizontally extensive, vertically movable support for the prizes, the support having a support drive mechanism operatively associated therewith;

a plurality of stationary vertical prize separating posts, distinct from the drive mechanism, extend upwardly through respective throughholes in the horizontally extensive support when the support is at a lowest position;

the grasping mechanism comprises a slip clutch portion and a torque controlling actuator for controlling a maximum torque transmitted by the slip clutch;

the apparatus comprises a controller having at least a first input representative of an action of the player and a second input from a sensor for measuring a value of a parameter representative of the grasping force exerted by the grasping mechanism, the controller having at least a first output to the drive mechanism for controlling a vertical position of the support and a second output to the torque controlling actuator for controlling the grasping force.

5. The crane game of claim 4 wherein the support driving mechanism is controlled by the controller and comprises at least three elevator posts extending upwardly through respective throughholes in the horizontally extensive support when the support is at the lowest position, each of the elevator posts having a respective worm shaft extending therealong, each of the worm shafts having a respective worm follower coupled thereto for upward and downward travel along the worm shaft, each of the worm followers respectively drivingly coupled to the support.

6. The crane game apparatus of claim 4 further comprising a visual display controlled by a second output from the controller to provide a display indicative of the value of the parameter representative of the grasping force.

7. The crane game apparatus of claim 4 wherein each of the stationary posts comprises a respective plurality of serrations shaped to allow abutting prizes to move upward when lifted by the movable support.

* * * * *